United States Patent [19]

Hattori

[11] 4,153,650

[45] May 8, 1979

[54] IDLING FUEL SUPPLYING SYSTEM OF A CARBURETOR

[75] Inventor: Kyo Hattori, Susono, Japan

[73] Assignee: Toyota Jidosha Kogyo Kabushiki Kaisha, Aichi, Japan

[21] Appl. No.: 833,961

[22] Filed: Sep. 16, 1977

[30] Foreign Application Priority Data

Jun. 15, 1977 [JP] Japan ..... 52-70011

[51] Int. Cl.[2] ..... F02M 3/08

[52] U.S. Cl. ..... 261/41 D

[58] Field of Search ..... 261/41 D

[56] References Cited

U.S. PATENT DOCUMENTS

| | | | |
|---|---|---|---|
| 1,838,676 | 12/1931 | Heitger | 261/41 D |
| 2,415,435 | 2/1947 | Mallory | 261/41 D |
| 3,363,886 | 1/1968 | Walker | 261/41 D |
| 3,410,539 | 11/1968 | Walker | 261/41 D |

FOREIGN PATENT DOCUMENTS

| | | | |
|---|---|---|---|
| 663276 | 1/1937 | Fed. Rep. of Germany | 261/41 D |

*Primary Examiner*—Tim R. Miles

*Attorney, Agent, or Firm*—Stevens, Davis, Miller & Mosher

[57] ABSTRACT

Disclosed is an idling fuel supplying system of a carburetor used for internal combustion engines, comprising an idle port which is communicated with a fuel float chamber and is opened into an intake passage at the downstream side of the throttle valve. In the intake passage there is an idling fuel deflecting means disposed parallel to the intake passage and opposite to the idle port. The deflecting means serves to prevent the idling fuel, which is injected from the idle port into the intake passage, from being absorbed by the sucked air into the area of the downstream side of the throttle valve, in which area the sucked air flows backwardly.

4 Claims, 6 Drawing Figures

IDLING FUEL SUPPLYING SYSTEM OF A CARBURETOR

BACKGROUND OF THE INVENTION

This invention relates to a carburetor used for internal combustion engines, and more particularly relates to an idling fuel supplying device of a carburetor having a means for improving the atomization characteristic of liquid fuel exhibited during the idle driving condition of internal combustion engines.

Generally speaking, a carburetor is used as a device for supplying fuel in a gas internal combustion engine which is most widely used as a prime mover of vehicles. Such a carburetor usually consists of a high-speed fuel supplying system (main supplying system) and a low-speed fuel supplying system (slow supplying system). The low-speed fuel supplying system is caused to perform a low-speed operation, a light-loading operation or an idling rotation of an internal combustion engine by supplying a small amount of liquid fuel into an intake passage at the downstream of a throttle valve through an idle port and a slow port when the throttle valve closes, i.e., during an idle driving condition or when the opening of the throttle valve is small, i.e., during the low-speed driving condition.

No special means is provided in the conventional carburetor for improving the atomization characteristic of the liquid fuel being fed into the intake passage during the idle driving condition. Therefore, during the idle driving condition or during the low-speed driving condition, since the opening of the throttle valve is small, a part of the air sucked into the intake passage flows downwardly in the downstream side of the throttle valve to generate a vortex flow. When fine grains of liquid fuel injected from the idle port are absorbed by the downstream area and come into contact with the downstream side wall of the throttle valve, these fine grains agglomerate on the wall to become larger fuel grains which are then sucked, without any changes in form, into combustion chambers of the engine. Otherwise, the liquid fuel grains are caught on the inner wall of the intake passage and caused to flow into the combustion chambers along the inner wall of the intake passage in the state of a liquid membrane. Therefore, during the idle driving condition, the atomization characteristic of the liquid fuel is not effective and a uniform air and fuel mixture cannot be obtained. Due to these negative factors, the combustion characteristic, the stability in the revolutions of the engine and the fuel consumption of the internal combustion engine are also negatively affected. In addition, poisonous combustible substances, such as hydrocarbons (HC), carbon monoxides (CO) and the like, are contained in the exhaust gas.

SUMMARY OF THE INVENTION

It is an object of this invention to provide an idling fuel supplying system of a carburetor in which it is possible to overcome the defects of the conventional carburetors as mentioned above.

It is another object of this invention to provide an idling fuel supplying system of a carburetor in which the atmization characteristic exhibited during the idle driving condition is improved.

It is still another object of this invention to provide an idling fuel supplying system of a carburetor in which during the idle driving condition the stability in the revolutions of the engine is improved and the fuel consumption and the noxious exhaust substances are reduced.

Provided in accordance with the present invention is an idling fuel supplying system of a carburetor used for internal combustion engines comprising: an intake passage communicated with the engine combustion chambers, a venturi portion formed in the intake passage, a main nozzle disposed in the venturi portion and communicated with a fuel float chamber, a throttle valve disposed in the intake passage, at the downstream side of the throttle valve, an idle port communicated with the fuel float chamber and opened into the intake passage at the downstream side of the throttle valve and an idling fuel deflecting means positioned in the intake passage opposite to the idle port, in order that idling fuel injected into the intake passage from the idle port is prevented from being absorbed by the sucked air into the area of the downstream side of the throttle valve, in which area the sucked air flows backwardly.

The idling fuel deflecting means may be a plain partition wall disposed substantially parallel to the intake passage, or may be a semicylindrical partition wall disposed substantially parallel to the intake passage.

Furthermore, the idling fuel deflecting means can be used in combination with the idle port, the injection top end of the idle port inwardly projecting from the inner wall of the intake passage, or with a pipe member mounted on an idle port so as to inwardly project the injection top of the idle port from the inner wall of the intake passage.

BRIEF DESCRIPTION OF THE DRAWINGS

In the drawings:

Referring now to FIGS. 4 and 5, a conventional carburetor known in the prior art is illustrated in which an intake passage 1 has a main nozzle 3 in a venturi portion thereof, which nozzle 3 is communicated with a fuel float chamber 4. The intake passage 1 also has a throttle valve 5 in the downstream side of the venturi portion 2, which intake passage 1 is provided with an idle port 6 which is positioned to open to the intake passage 1 at the downstream of the throttle valve 5. This idle port 6 is also communicated with the fuel float chamber 4 through a passage 7. The idle port 6 is provided with an idle adjusting screw 9 for adjusting the amount of idling fuel.

Figure 1:
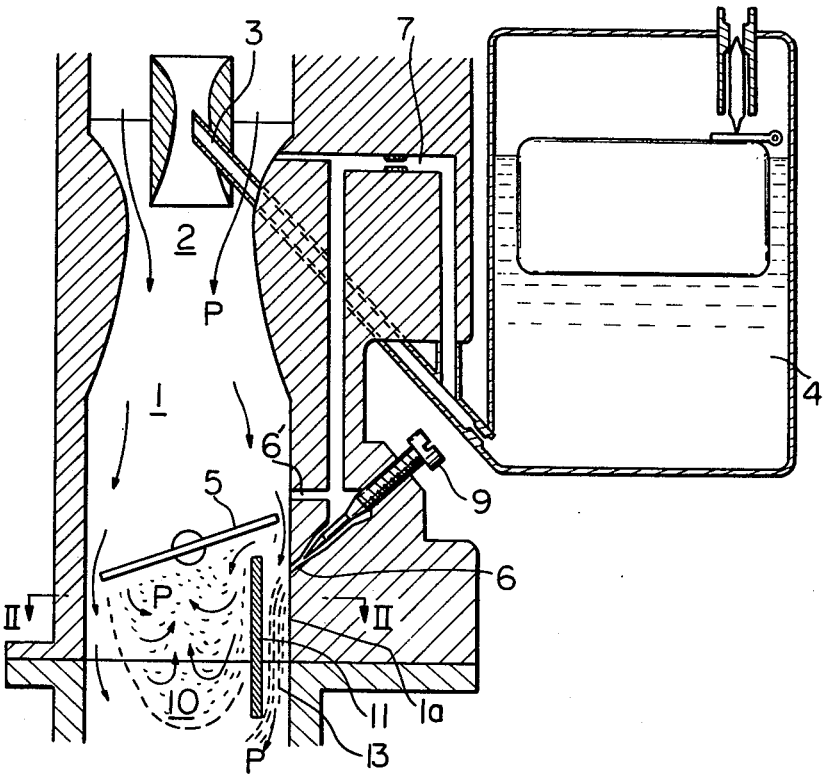
FIG. 1 is a cross-sectional view of a carburetor employing an idling fuel supplying system of this invention.

When a middle or heavy load driving operation, i.e., the opening degree of the throttle valve 5 is from an $\frac{1}{8}$ opened position to a completely opened position, a sufficient amount of negative pressure is generated in the venturi portion 2, so that fuel is injected from the main nozzle 3 into the intake passage 1. However, during the low load or idle driving operation, i.e., the opening degree of the throttle valve 5 is not more than $\frac{1}{8}$ of the completely opened position, the velocity of air flowing in the intake passage is too low to generate a sufficient amount of negative pressure for sucking fuel from the main nozzle 3. Idling fuel is, therefore, sucked from a slow port 6' and the idle port 6 into the intake passage 1 in order to operate the engine under a low speed or idle rotating condition.

Figure 4:
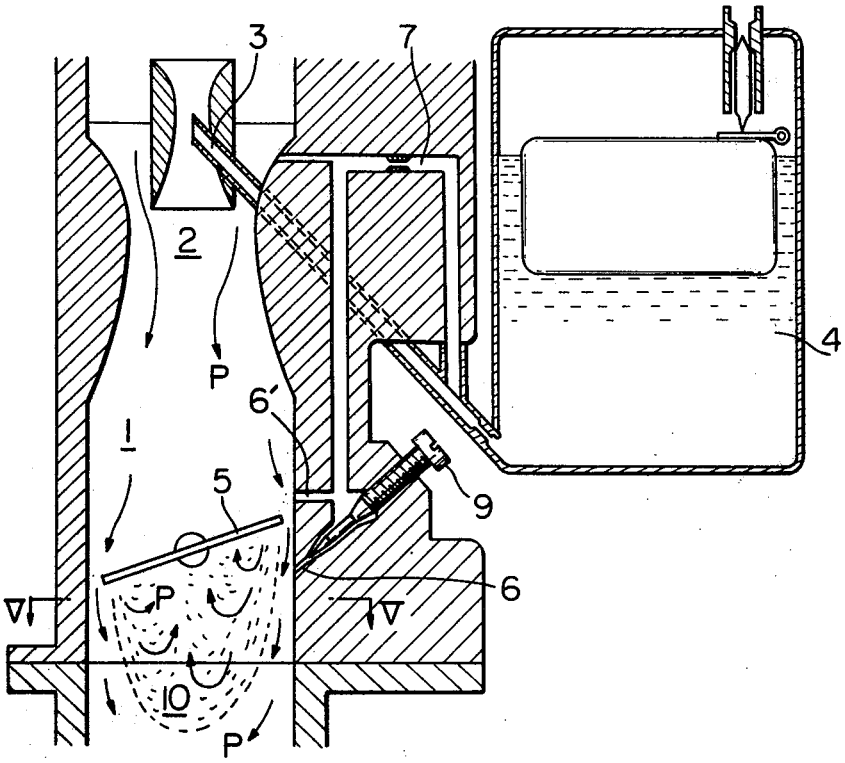
Fig. 4 PRIOR ART
FIG. 4 is a cross-sectional view of a conventional carburetor.

During idle driving operation, since the opening degree of the throttle valve 5 is small, a part of the air sucked into the intake passage flows backwardly at the downstream area of the throttle valve as indicated by arrows p in FIG. 4, to generate a vortex flow. When fine grains of liquid fuel injected from the idle port 6 are absorbed by the sucked air in the downstream area, the above-mentioned problems occur.

DESCRIPTION OF THE PREFERRED EMBODIMENTS

Figure 2A:
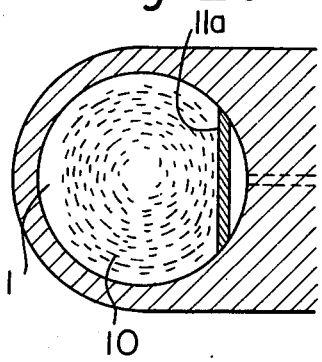
FIGS. 2(*a*) and 2(*b*) are cross-sectional views taken along line II—II in FIG. 1 and showing embodiments of the fuel reflecting means, respectively.
Figure 2B:
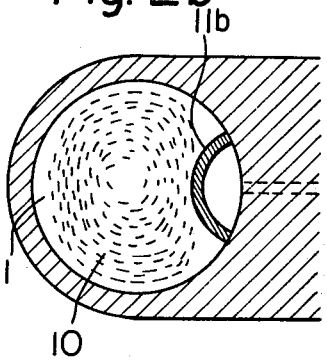
Figure 3:
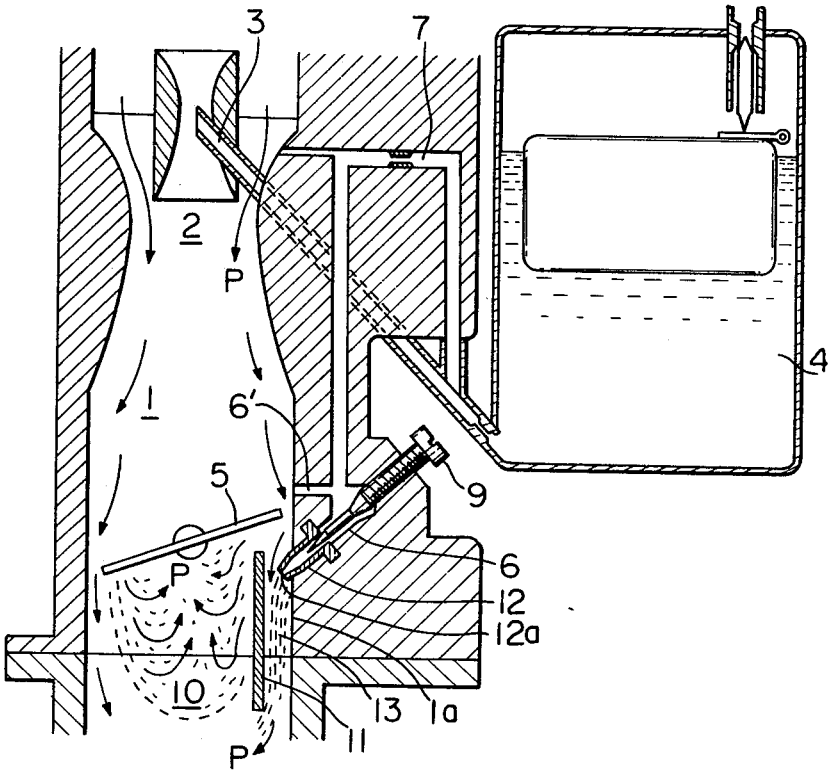
FIG. 3 is a cross-sectional view of a carburetor employing a modified idling fuel supplying system of this invention.
Figure 5:
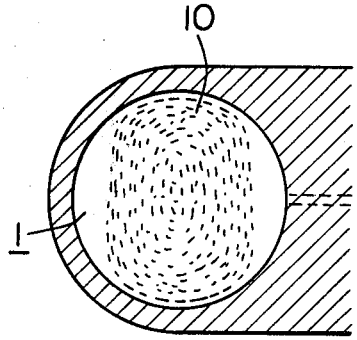
Fig. 5 PRIOR ART
FIG. 5 is a cross-sectional view taken along line V—V in FIG. 4.

Carburetors having an idling fuel supplying system according to this invention are shown in FIGS. 1 through 3. Each of the carburetors, shown in FIG. 1 and also shown in FIG. 2, comprises an intake passage 1 having a main nozzle 3 in a venturi portion thereof, which main nozzle 3 communicates with a fuel float chamber 4. The intake passage 1 also has a throttle valve 5 in the downstream side of the venturi portion 2, and is provided with an idle port 6 which is positioned to open to the intake passage 1 at the downstream of the throttle valve 5 when the valve 5 is closed. This idle port 6 is also communicated with the fuel float chamber 4 through a passage 7. The idle port 6 is provided with an idle adjusting screw 9 for adjusting the amount of idling fuel. The construction of the carburetor described above is the same as that of the conventional one, mentioned hereinbefore with reference to FIGS. 4 and 5. A slow port, indicated by reference number 6', is provided at the upstream side of the idle port 6 and has an arrangement which is also the same as that of the conventional one.

In FIG. 1, according to the present invention, a sufficient length of an idling fuel deflecting means 11 is suitably positioned in the intake passage 1 opposite to the idle port 6. This deflecting means serves to prevent the idling fuel, which is injected from the idling port 6 into the intake passage 1, from being absorbed by the sucked air into the above-mentioned area in the downstream side of the throttle valve 5, in which area the sucked air flows backwardly. The idling fuel deflecting means 11 may be a plain partition plate 11*a* disposed substantially parallel to the intake passage 1, as shown in FIG. 2*a*, or may be a semicylindrical partition wall 11*b* disposed substantially parallel to the intake passage 1, as shown in FIG. 2*b*.

Disposed in the carburetor shown in FIG. 3, there is an idling fuel deflecting means 11 consisting of a plain partition plate 11*a* or a semicylindrical partition wall 11*b*, similar to those mentioned above. This carburetor further comprises an additional pipe member 12 mounted on the end of the idle port 6, through which idling fuel is injected into the intake passage 1, so that the fuel injecting end of the pipe member 12 inwardly projects from an inner wall 1*a* of the intake passage 1.

According to this invention, at the idle driving operation in which the opening degree of the throttle valve 5 is small, although a part of air sucked into the intake passage 1 flows backwardly in the downstream area of the throttle valve to generate a vortex flow therein, the fine grains of liquid fuel injected from the idle port 6 into the intake passage 1 are prevented from being absorbed by the sucked air into the downstream area, because they are deflected by the idling fuel deflecting means. The fine grains of the idling fuel are, therefore, sucked into the intake passage 1 through a gap formed between the deflecting means 11 and an inner wall 1*a* of the intake passage 1. A part of the idling fuel may attach onto the surface of the deflecting means 11. Such fuel is, however, atomized again into fine fuel grains by the relatively high-speed air flow passing through a gap 13 as well as by a spraying effect (or an edge effect) of the liquid fuel grains at the bottom end of the deflecting means 11. In the embodiment shown in FIG. 3, as the top end of the idle port 6, through which liquid fuel is injected, is projected inwardly from the inner wall 1*a* of the intake passage 1, idling fuel is prevented from flowing along the inner wall 1*a* of the intake passage 1, which flowing is known as a wall surface flow. It is desirable that the shape of the idling fuel deflecting means be of a shape streamlined with respect to the direction of air flowing in the intake passage 1 in order that the direction of the air flow in the intake passage be changed as little as possible by the deflecting means, especially by the top and bottom ends of the deflecting means.

What is claimed is:

1. A carburetor for an internal combustion engine, said carburetor comprising:

a vertically extending intake passage;

a venturi in said passage;

a chamber for containing fuel;

a main nozzle in fluid communication with said fuel chamber, said nozzle opening directly into said venturi;

a non-perforate throttle valve in said intake passage downstream of said venturi;

an idle port in fluid communication with said fuel chamber, said port opening directly into said intake passage downstream of said throttle valve; and a straight vertically extending idling fuel deflecting wall for deflecting fuel from said idle port downwardly in said intake passage, said wall being in said intake passage below said throttle valve, the upper end of said wall being coextensive with said idle port, said wall extending well below said port in said passage, said wall defining with and within said intake passage a straight vertically extending second passage of substantially uniform transverse cross-sectional area and of substantially smaller transverse cross-sectional area than said intake passage whereby fuel from the idle port enters said second passage and flows downwardly through said second passage.

2. A carburetor as set forth in claim 1, wherein the end of said idle port, through which idling fuel is injected, is inwardly projected from an inner wall of said intake passage.

3. A carburetor as set forth in claim 1, wherein said deflecting wall comprises a plain partition plate.

4. A carburetor as set forth in claim 1, wherein said deflecting wall comprises a semi-cylindrical partition wall.

* * * * *